US007750290B2

(12) United States Patent
Fourrier et al.

(10) Patent No.: US 7,750,290 B2
(45) **Date of Patent: *Jul. 6, 2010**

(54) LASER RADIATION DESORPTION DEVICE FOR MANIPULATING A LIQUID SAMPLE IN THE FORM OF INDIVIDUAL DROPS, THEREBY MAKING IT POSSIBLE TO CARRY OUT THE CHEMICAL AND BIOLOGICAL TREATMENT THEREOF

(75) Inventors: Jean-Christophe Fourrier, Montceau-les-Mines (FR); François Caron, Douai (FR); Pierre Tabourier, Calais (FR); Christian Druon, Villeneuve d'Ascq (FR); Denis J-P Loyaux, Belbeze du Lauragais (FR); Jean-Pierre Antoine Lepesant, Ventabren (FR); Christian Rolando, Antony (FR)

(73) Assignees: Universite des Sciences et Technologies de Lille, Villeneuve d'Ascq Cedex (FR); Centre National de la Recherche Scientifique (CNRS), Paris Cedex (FR)

( * ) Notice: Subject to any disclaimer, the term of this patent is extended or adjusted under 35 U.S.C. 154(b) by 432 days.

This patent is subject to a terminal disclaimer.

(21) Appl. No.: 11/628,441
(22) PCT Filed: Jun. 6, 2005
(86) PCT No.: PCT/FR2005/001384
§ 371 (c)(1),
(2), (4) Date: Sep. 7, 2007
(87) PCT Pub. No.: WO2006/003292
PCT Pub. Date: Jan. 12, 2006

(65) Prior Publication Data

US 2008/0156983 A1 Jul. 3, 2008

(30) Foreign Application Priority Data

Jun. 4, 2004 (FR) ..... 04 06081

(51) Int. Cl.
*H01J 49/04* (2006.01)

(52) U.S. Cl. ..... 250/288; 250/281; 250/282

(58) Field of Classification Search ..... 250/281, 250/282, 288; 436/178; 73/864.81, 864.83, 73/864.84, 864.85; 435/288.2, 285.2, 286.2, 435/286.3, 286.4, 287.8, 288.4; 205/133, 205/98, 80; 204/194, 400, 403.01, 403.03
See application file for complete search history.

(56) References Cited

U.S. PATENT DOCUMENTS 6,565,727 B1 5/2003 Shenderov (Continued)

FOREIGN PATENT DOCUMENTS

WO WO 03/045556 6/2003
WO WO 2005/019875 3/2005

OTHER PUBLICATIONS

Chiu, D.T.. "Micro- and nano-scale chemical analysis of individual sub-cellular compartments." *Trends in Analytical Chemistry*. vol. 22, No. 9, 2003. pp. 528-536.

(Continued)

*Primary Examiner*—Jack I Berman
*Assistant Examiner*—Nicole Ippolito Rausch
(74) *Attorney, Agent, or Firm*—Ladas & Parry LLP

(57) ABSTRACT

The invention relates to an integrated system for microfluidic analysis of a liquid sample comprising a liquid sample preparing means (100) which is provided with a displacement means (101) for introducing the sample and reagents and for transmitting said sample and reagents to a second means (200) for chemically or biochemically treating the liquid sample drops, wherein said treating means comprises also means (201) for displacing sample drops to means (300) for drop analysis. Said invention is particularly suitable for a laser radiation desorption device comprising a system for manipulating the sample and reagents in the form of drops, which is provided with one or several loading posts, one or several transport paths consisting of interdigitated electrodes, one or several chemical or biochemical treatment areas and at least one system for switching to a conductive post on which a laser radiation desorption can be carried out.

17 Claims, 7 Drawing Sheets

U.S. PATENT DOCUMENTS

Figure 1A:
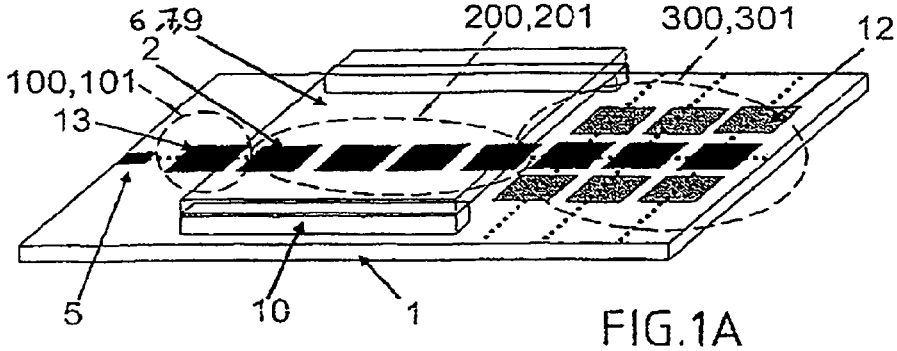

| | | | | |
|---|---|---|---|---|
| 2003/0205632 | A1 | 11/2003 | Kim et al. | |
| 2004/0055536 | A1 * | 3/2004 | Kolar et al. | 118/626 |
| 2004/0055891 | A1 * | 3/2004 | Pamula et al. | 205/98 |
| 2004/0058450 | A1 * | 3/2004 | Pamula et al. | 436/150 |
| 2006/0013735 | A1 * | 1/2006 | Engelking et al. | 422/99 |
| 2006/0200044 | A1 * | 9/2006 | Freeman et al. | 600/583 |

OTHER PUBLICATIONS

Sung Kwon Cho, et al: "Creating, Transporting, Cutting and Merging Liquid Droplets by Electrowetting-Based Actuation for Digital Microfluidic Circuits;" Journal of Microelectromechanical Systems, vol. 13, No. 1, Feb. 2003.

Chao-Yi-Chen, et al; "Electrowetting-Based Microfluidic Devices: Design Issues;" 2003 Summer Bioengineering Conference, Jun. 25-29.

* cited by examiner

LASER RADIATION DESORPTION DEVICE FOR MANIPULATING A LIQUID SAMPLE IN THE FORM OF INDIVIDUAL DROPS, THEREBY MAKING IT POSSIBLE TO CARRY OUT THE CHEMICAL AND BIOLOGICAL TREATMENT THEREOF

This present invention concerns an integrated system for the microfluidic analysis of a liquid sample, which in particular though not uniquely, finds its application in analysis by laser radiation desorption, which includes handling the liquid sample in the form of individual drops to allow their chemical and biological treatment.

Desorption by laser radiation allows the vaporisation of a substance present on a surface. This effect combines with ionisation molecules present at the surface. This phenomenon has been used in mass spectrometry under the name of MALDI (matrix assisted laser desorption ionisation) in which the energy of the laser beam is stored and then restored by the matrix, which is organic in most cases but which can also contain nanoparticles whose absorption is in the wavelength range of the laser beam.

In order to achieve satisfactory results in MALDI mass spectrometry, the sample must contain a very small quantity of inorganic salts, typically a concentration of the order of less that one in a thousand. Typically the sample is therefore demineralised before its analysis by MALDI mass spectrometry, and this is followed by additional stages, and reduces the sensitivity of the method. The techniques most used currently are demineralisation in hydrophobic columns of the grafted alkyl chain type. Special demineralisations using cationic or anionic resins can also be used.

More generally, either wetting or hydrophylic additives can then be used in order to create wettability in relation to any liquid, and non-wetting or hydrophobic additives to create non-wettability in relation to any liquid.

In addition, most biological samples are complex, and include hundreds or even thousands of different molecules. Typically, a trypsic digestate of the proteins contained in tissue contains ten thousand to one hundred thousand different peptides. This is why these samples are subjected to a preliminary fractionation, using affinity columns as in the ICAT technology (isotope coded affinity tags) which, in addition to its complexity, considerably reduces the sensitivity of the method. These biological samples are moreover available in very small quantities, and it is thus necessary to be in possession of a biopsy gram for the execution of a proteomic analysis, which renders these analyses impossible on human samples.

The MALDI technique is most frequently used on a metal surface. In order to minimise the drawbacks mentioned previously, various arrangements of these metal surfaces have been described. The first solutions had as their objective to improve sensitivity. To begin with, surfaces or only small zones are metallic, leading to a local concentration of the sample. In order to remove the salts, surfaces are created from a polymer of the brush type, which allows a demineralisation of the sample in situ. In order to perform the fractionating, surfaces of the cationic or anionic resin type allow the immobilisation of a single family of compound of opposite polarity. And finally, surfaces are grafted by biological compounds (biotine, avidine, antibodies) to allow purification by affinity of complex mixtures.

All of these surfaces are static and include no fluidic system allowing the movement and the treatment of the sample on the plate. Deposition is effected either manually or by an automatic control system that includes a head for the aspiration-deposition of an external liquid.

The microfluidic technique is currently becoming very popular, and is attempting to introduce innovative solutions, with new methods of analysis for example, in the areas of biology, analytical chemistry and chemical engineering. The reduction in the size of the systems is engendering many positive aspects such as a reduction in volumes, shorter reaction times or shorter exchange times, and the integration of several modules with different functions, such as transportation, treatment and analysis modules on a single wafer of silicon for example.

Two types of fluidic movement are possible, namely the pumping of a continuous flow and the movement of calibrated microvolumes of liquid. The pumping of calibrated microvolumes requires smaller volumes of liquid than continuous flow pumping, and allows easier control of the flow. By control of the time constants, the mixing of liquids for example, are thus easier to perform. Several pumping methods of this type are described in the literature, employing pumping by pneumatic action or by acoustic surface waves, pumping by dielectrophoretic effect, and pumping by electrowetting and electrowetting on dielectric. This last pumping method makes use of a simple technological process, and allows control over the flow and the circulation of the liquid in a network of microchannels.

Currently, the movement devices using the electrowetting principle require two substrates opposite to each other, or one single substrate (Creating, Transporting, Cutting, and Merging Liquid Droplets by Electrowetting-Based Actuation for Digital Microfluidic Circuits" Sung Kwon Cho, Hyejin Moon, and Chang-Jin Kim, Journal of Microelectromechanical Systems, VOL. 12, No. 1, February 2003, pp. 70-80).

The system with two substrates opposite to each other requires interdigitated electrodes on at least one of the two substrates, at least one insulating layer composed of inorganic oxides of non-metal metals, of transition metals, of polymers or of a combination of these different substances on one of the two substrates, and a hydrophobic layer on each substrate. The system with one single substrate requires interdigitated electrodes, an insulating layer composed of inorganic oxides of non metal -metal composites, of transition metals, of polymers or of a combination of these different substances, and a hydrophobic layer, with or without a ground line. The hydrophobic layer is the key of the movement, without which the movement is impossible as it is described in the article mentioned (Electrowetting-based microfluidic devices: design issues, C. Y. Chen, E. F. Fabrizio, A. Nadim and J. D. Sterling, Summer Bioengineering Conference 2003, pp. 1241-1242).

The hydrophobic layer is a material with a low surface energy and an excellent chemical resistance. As a consequence, it is very difficult to perform local chemical surface treatment, depositions or grafts on a hydrophobic layer without changing and/or damaging the whole of the surface of this hydrophobic layer, and this reduces or cancels out the effectiveness of the electrowetting regarding the movement of liquid. Thus, the use of this system covered by a hydrophobic layer is mainly limited to liquid movement only.

Thus in order to achieve a system that allows the treatment of biological samples for example, it is necessary to have functionalised zones that interact with the liquid. Now the hydrophobic layer forbids any prior functionalisation of zones with which the liquid may be in contact. In order to remedy this, the proposed solution consists of creating hydrophilic openings in the hydrophobic material. These hydrophilic openings, which are also known as open zones or openings, can then be treated chemically and the liquid can interact with this surface.

This present invention concerns devices for desorption by laser radiation that include handling the liquid sample in the form of individual drops to allow chemical and biological treatment.

The device for desorption by laser radiation includes at least one pad for loading the liquid sample, at least one transportation track composed of interdigitated electrodes, at least one chemical or biochemical treatment zone, and a system for routing to at least one conducting pad where a process of desorption by laser radiation can be effected.

The invention takes the form of an insulating substrate onto which interdigitated electrodes are placed, isolated from the samples moved via an insulating and functionalisable upper layer, of inorganic oxides of non-metals, metals, transition metals or polymers, or of a combination of these different substances. A non-wetting layer, allowing the appearance of wetting zones, is then deposited. This layer, said to be partially wetting, allows the functionalisable insulation layer to appear. After treatment, these openings in the non-wetting layer constitute the functionalised zones of the treatment module.

The system can come in the form of two substrates opposite to each other. On one of the substrates, there rests a transportation track for the samples or reagents. The functionalised zones rest on the second substrate. The whole of the two substrates is separated by a space that is intended to be filled with an electrically insulating fluid which is not miscible in relation to the liquids transported.

In addition to a treatment module, the system can also include:

- a module which allows the introduction of a biological sample, as well as of the liquids necessary for the analysis (rinsing solution, etc.),
- a module used for the fractionation of liquids into several drops,
- one or more biochemical interaction modules. Example for the analysis of proteins—affinity, digestion, demineralisation module,
- a transition module between the treatment zone and the analysis zone,
- an analysis module which, for example, places the samples to be analysed on pads where a matrix can be added, and on which an analysis by mass spectrometry of the MALDI type is possible, or indeed by optical detection or fluorescence.

More generally the invention relates to an integrated system for the microfluidic analysis of a liquid sample that includes at least one means (100) for preparing the liquid sample, where the said preparation means (100) includes a moving means (101) for the introduction of the said sample and of reagents, and then their migration to at least one means (200) for the chemical or biochemical treatment of drops of the said liquid sample, where the said treatment means (200) includes means (201) for moving the said drops of the said sample, and then their migration to at least one means (300) for the analysis of the said drops of the said liquid sample, characterised in that the analysis means (300) is a means for analysis by laser radiation desorption and includes firstly means (301) for movement of the drops of the sample, and secondly at least one means for routing the drops to independent analysis pads.

The means (100) for preparing the liquid sample can include at least a liquid loading dock.

The preparation means (100) can include at least one zone (102) for the deposition of liquid.

At least one of the moving means (101, 201, 301) can include at least one conducting pad, covered by a partially wetting layer that includes at least one wetting zone facing the said conducting pad.

The system can also include an insulating layer inserted between the conducting pad and the partially wetting layer.

The wetting zones are possibly functionalised, chemically or biochemically.

The means (201) for moving, in the chemical or biochemical treatment means (200), can include two substrates, opposite to each other, and/or at least one means for the fractionating of one drop from several, and/or at least one means for the removal of excess or exhausted reagents.

At least one of the moving means (101, 201, 301) is of the movement by electrowetting on dielectric type.

The chemically or biochemically functionalised zones are hydrophilic zones for interaction with the moved liquid.

The analysis means (300) includes means for analysis of the MALDI type by laser radiation with desorption-ionisation, and/or of the optical detection type.

The invention also relates to a device (300) for the analysis of a liquid sample by laser radiation desorption, characterised in that it includes means (301) for moving the drops of the sample, and at least one means for routing the drops to independent analysis pads.

The moving means (301) can possibly include at least one conducting pad, covered by a partially wetting layer that includes at least one wetting zone opposite to the said conducting pad.

Preferably, the device includes an insulating layer inserted between the conducting pad and the said partially wetting layer.

Possibly, the wetting zones are functionalised chemically or biologically. These zones can be hydrophilic zones for interaction with the moved liquid.

Again preferably, the moving means (301) is of the movement by electrowetting on dielectric type. The device can possibly finally include an analysis means of the MALDI type by laser radiation desorption-ionisation, and/or of the optical detection type.

Figure 1B:
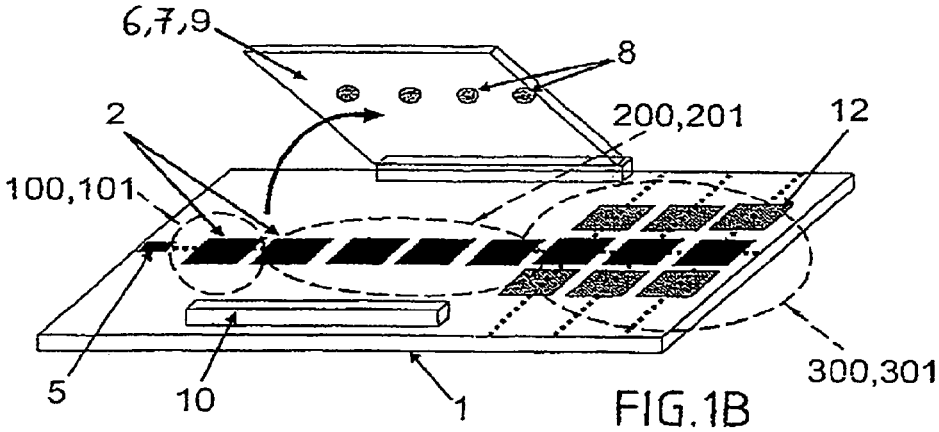
Figure 1C:
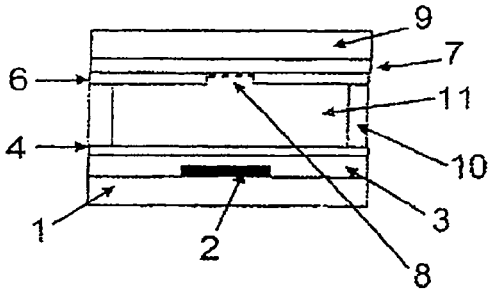
Figure 2:
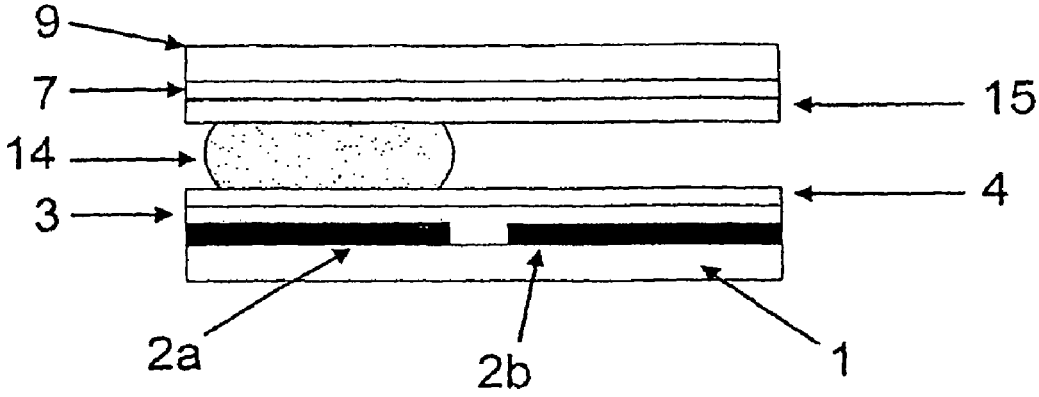
Figure 3:
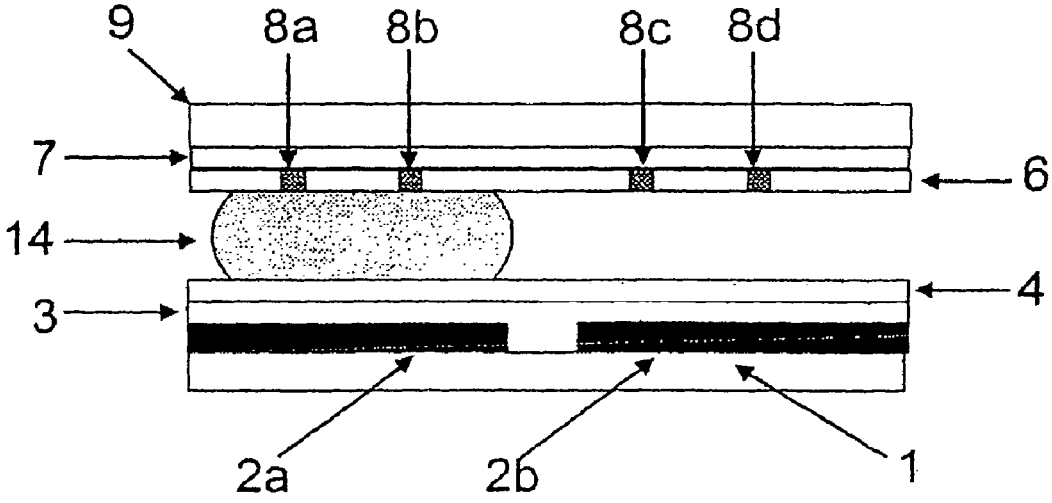
Figure 5:
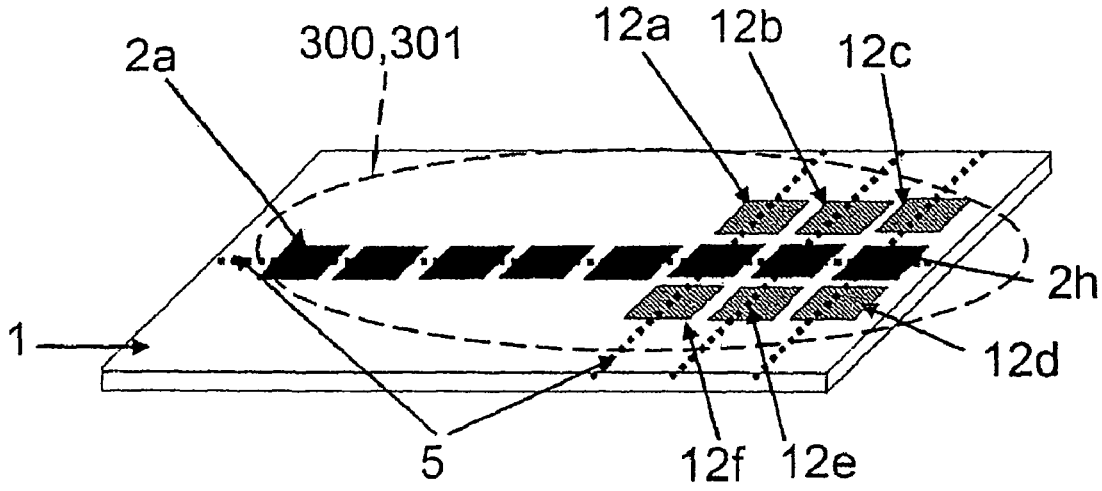

Other characteristics and advantages of the invention will appear more clearly and more fully on reading the description that follows of the preferred implementation variants for execution of the method and for creation of the device, which are given by way of non-limiting examples and with reference to the following appended drawings:

FIGS. 1*a* to 1*c* schematically present a device for the analysis of biological samples, with integrated MALDI target;

FIG. 2 schematically presents a device for moving a drop between 2 tracks;

FIG. 3 schematically presents a device for moving a drop between 2 tracks, with functionalised zones on the upper track;

FIG. 4 schematically presents a device for moving a drop on a track;

FIG. 5 schematically presents a device for the analysis of biological samples by MALDI mass spectrometry;

FIG. 6 schematically presents a device for the analysis of proteins from biological samples, with MALDI target integrated with 3 biochemical treatments before analysis (concentration, digestion and demineralisation).

FIGS. 1*a* to 1*c* schematically show a device for the analysis of biological samples, with MALDI target, seen in perspective in 1*a* and 1*b*, and seen in section perpendicular to the direction for moving the drop in 1*c*.

In these FIGS. 1*a* to 1*c*, the device includes a track with a substrate 1. The interdigitated electrodes 2 are located above this substrate 1.

On these electrodes 2 there is an insulating dielectric layer 3, composed, for example, of oxides or polymers. On this electric insulating layer 3 there is a non-wetting layer 4. Between layer 3 and layer 4, a conducting line 5 acts as a counter-electrode.

Opposite to the first track is placed a second track formed from a partially wetting layer 6, itself covered with a top layer 7 on which biochemical functions 8 can be grafted. The layer 7 is on a substrate 9 that can be used as a counter-electrode. The use of spacers 10 allows a movement space 11 to be maintained, intended to be filled with an electrically insulating fluid which is non-miscible in relation to the drop transported. On this substrate, the pads 12 are conductors and are used to immobilise the drops transporting the materiel to be analysed before matrix deposition for the MALDI analysis.

The liquids (the drops of samples or reagents for example) are deposited on the pad 13. The liquid then enters into the chemical or biochemical treatment zone between the substrates 1 and 9, and interacts with the functionalised zones 8. The movement pads 2 then allow the conveyance of each individual drop (14) up to one of the pads 12. Then follows a stage of matrix deposition, crystallisation and MALDI analysis.

FIG. 2 schematically shows the movement of a drop between two tracks, seen in section in the direction of the movement. The device includes a first track composed of layers 1, 2, 3, and 4, and a second track composed of layer 7, a substrate 9, and a non-wetting layer 15. By putting a potential difference between electrode 2*b* and substrate 9, the drop is contained between electrode 2*b* and substrate 9, and the result is a movement of the drop from electrode 2*a* to electrode 2*b*.

FIG. 3 schematically presents a device for moving a drop 14 between two tracks with functionalised zones on the upper track, seen in section in the direction of the movement. The device includes a first track composed of layers 1, 2, 3, and 4, and a second track composed of layers 6 and 7, a substrate 9 and functionalised zones 8*a* to 8*d*. By putting a potential difference between electrode 2*b* and substrate 9, the drop is contained between electrode 2*b* and substrate 9, and the result is a movement from electrode 2*a* to electrode 2*b*. The drop then interacts with the functionalised zone 8*c* and 8*d*.

Figure 4A:
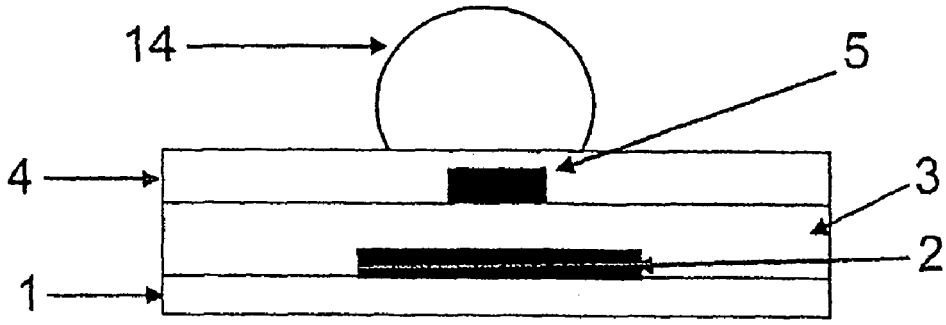
Figure 4B:
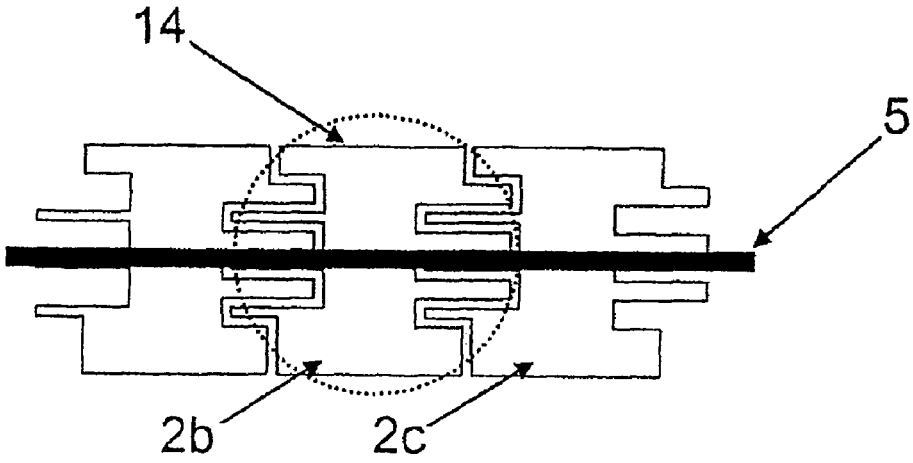

FIG. 4 schematically presents a device for moving a drop on a track. FIG. 4*a* is seen in section perpendicular to the direction of the movement of the drop, and FIG. 4*b* is a top view of the device. The device includes a track composed of layers 1, 2, 3, 4 and 5. By putting a potential difference between electrode 2*c* and line 5, the result is a movement of the drop (14) from electrode 2*b* to electrode 2*c*.

FIG. 5 presents, schematically and in perspective, a device for the analysis of biological samples by MALDI mass spectrometry. By successively applying potential differences between electrodes 2*a* to 2*h* and line 5, it is possible to move the drop 14 and to immobilise it on one of the pads 12*a* to 12*f*. Then follows a stage of matrix deposition, crystallisation and MALDI analysis.

Figure 6A:
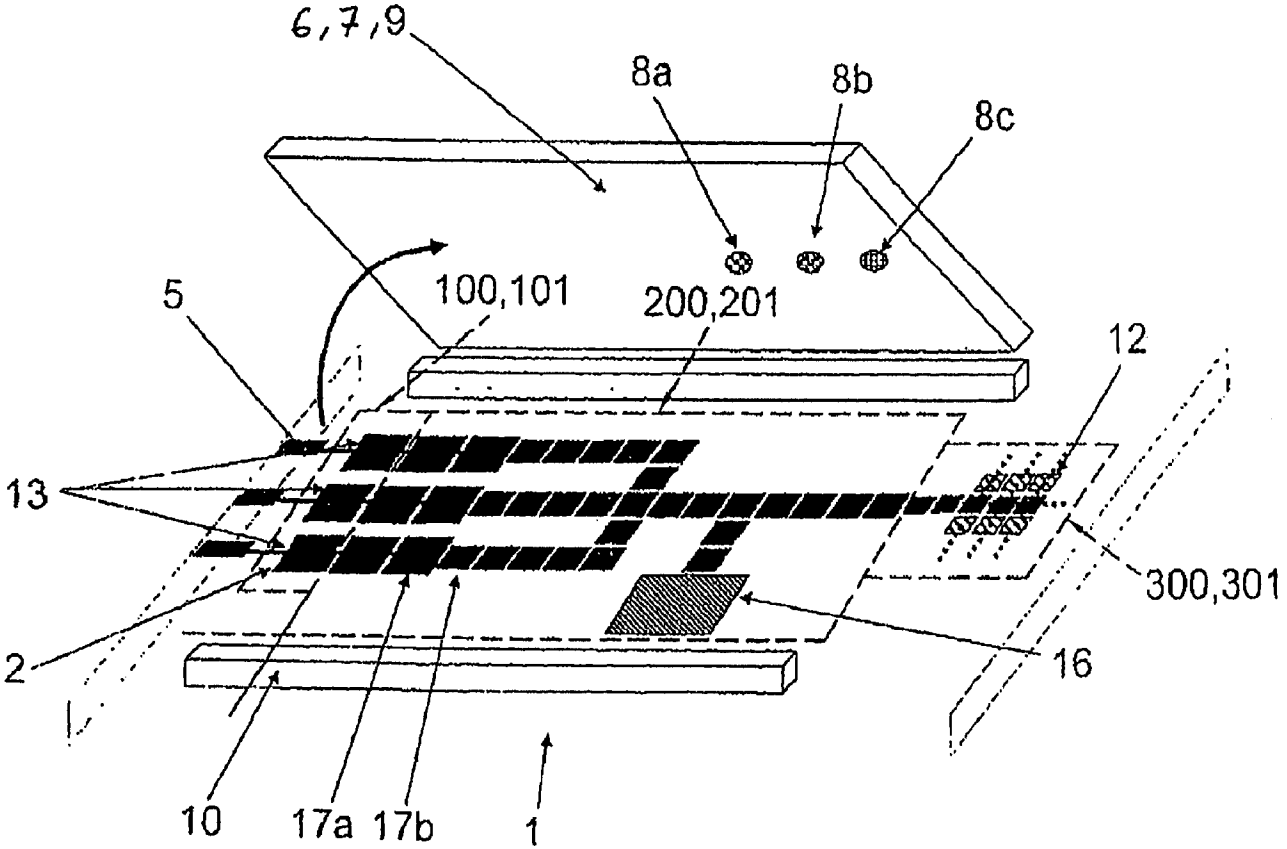
Figure 6B:
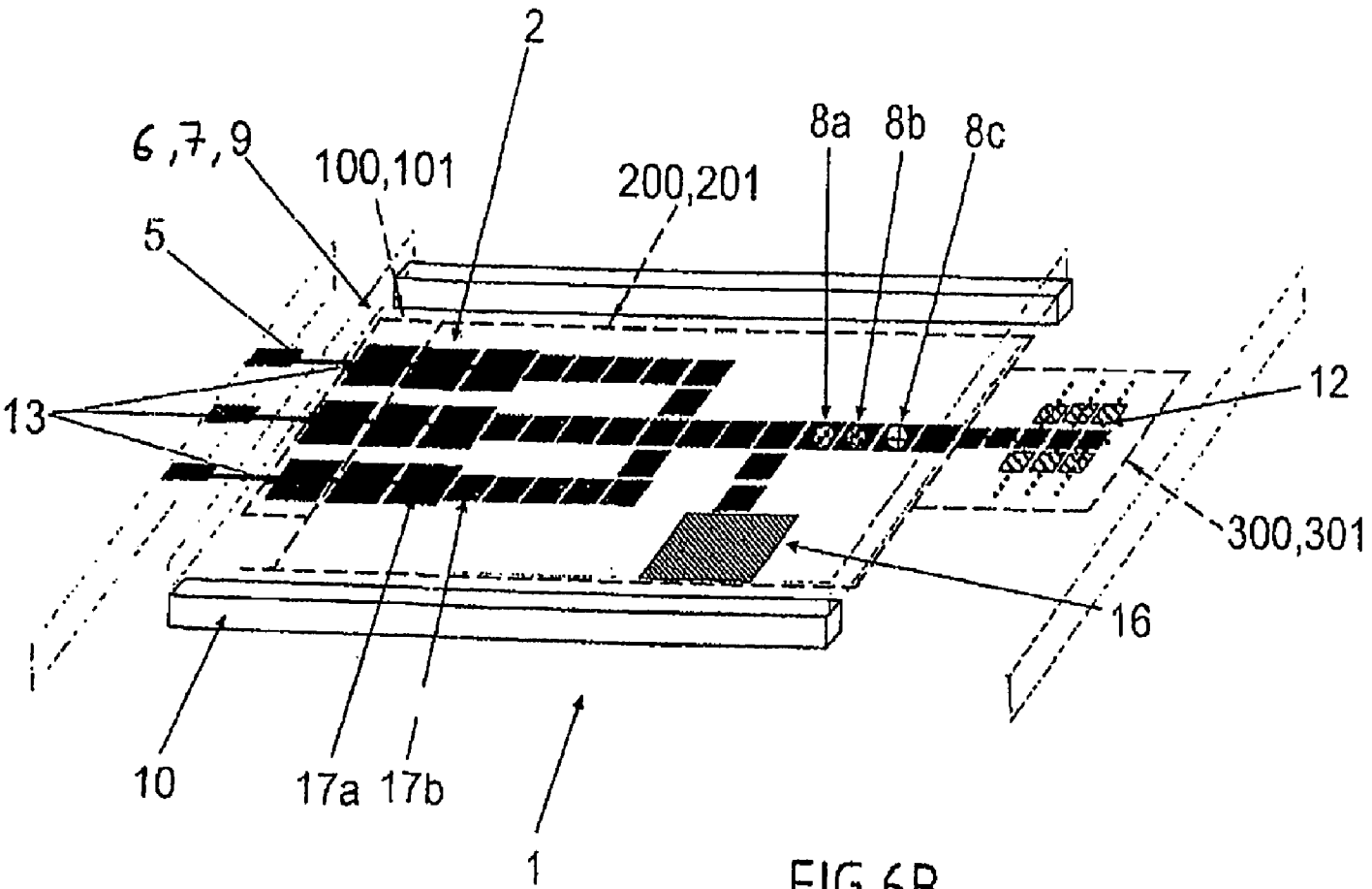
Figure 6C:
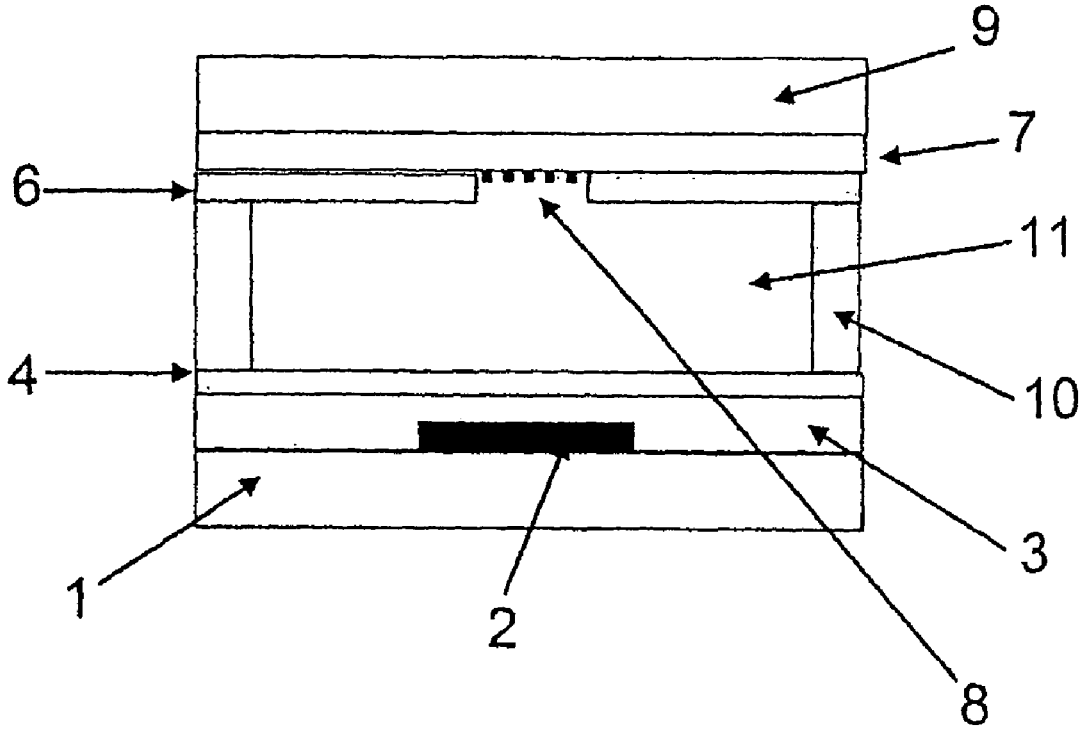

FIGS. 6*a* to 6*c* schematically show a device for the analysis of proteins of biological samples with integrated targets, with three chemical or biochemical treatments before analysis (concentration, digestion and demineralisation) seen in perspective 6*a* and 6*b*, and seen in section perpendicular to the direction of the movement of the drop 6*c*.

The device includes a first track composed of layers 1, 2, 3, 4 and 5, a second track composed of layers 6 and 7, a substrate 9 and spacers 10. This device includes a pad 16 allowing the removal of excess or exhausted reagents, pads 12 for the MALDI analysis, and three functionalised zones for the affinity 8*a*, for the digestion 8*b* and for the demineralisation 8*c*.

The liquids (sample, reagent or rinsing drops for example) are deposited on the pads 13. The liquid then enters into the biochemical treatment zone between substrates 1 and 9 as a result of applying a potential difference. The transition between pads 17*a* and 17*b* allows fractionation of the liquid introduced in several drops. The drops are then routed to a first affinity pad 8*a* where the proteins of interest will be fixed. The drops are then conducted up to pad 16. A rinsing solution is then used to rinse the pad 8*a* using the same movement principle as previously. Then, a special solution (such as a denaturing buffer mixture) is used to free the molecules of interest and the proteins are brought to a protein digestion pad 8*b*. After the digestion stage, the drop is routed onto the demineralisation pad 8*c* before being conducted to one of the pads for the analysis of the MALDI type.

The following examples illustrate the functionalisation and the use of the devices described previously:

EXAMPLE 1

Affinity Reactor Used for the Treatment of Biological Samples

In the device, the zones not covered by the hydrophobic layer are subjected to surface treatment and transform them into reactive surfaces for example, using a surface support that includes amino groups (NH2) onto which streptavidine is grafted. The drop of liquid moving in the electrode path in a treated zone is thus immobilised, and the molecules of interest (proteins for example) which have an affinity for the grafted surfaces will be fixed onto these surfaces. When the chemical reaction has ended, the drop continues on its way in the device. Then, the passage of a special mixture (a denaturing buffer mixture for example) on these zones will free the molecules of interest (with destruction of the non-covalent reactions, for example) and will draw them along with it. This device is thus used to isolate molecules of interest.

EXAMPLE 2

Digestion Reactor Used for the Treatment of Biological Samples

In the device, the zones not covered by the hydrophobic layer are subjected to surface treatment which converts them into reactive surfaces for example, using a surface support that includes amino groups (NH2) onto which trypsine is grafted. The drop of liquid moving in the electrode path in a treated zone is thus immobilised, and the molecules of interest (proteins for example) react with the grafted surfaces which cuts the molecules, so as to obtain peptides for example in the case of digestion by trypsine. Then the drop continues on its way in the device. This device can be used for example to analyse long chains of molecules by prior cutting using special enzymes by mass spectrometry.

EXAMPLE 3

Treatment of Biological Samples—Demineralisation Module

In the device, the zones not covered by the hydrophobic layer are subjected to surface treatment which converts them into reactive surfaces for example by the grafting of hydrocarbonated chains of 18 carbons leading to the equivalent of a reverse chromatography phase known as C18. The drop of liquid moving in the electrode path on a treated zone is thus immobilised, and the molecules of interest (proteins for example) react with the grafted surfaces which cut the molecules. Then the drop continues on its way in the device. This device can be used, for example, to perform demineralisation before analysis by MALDI mass spectrometry.

The invention claimed is:

1. A device for laser radiation desorption analysis of a liquid sample comprising drops, including electro-wetting moving means for moving said drops of said sample, and at least one means for routing the drops to at least one independent analysis pad, wherein said electro-wetting moving means includes at least one conducting pad, covered by a partially wetting layer consisting in a layer made of a non-wetting material comprising wetting openings, said partially wetting layer having at least one wetting zone opposite to said conducting pad.

2. A device according to claim 1, further comprising an insulating layer inserted between said conducting pad and said partially wetting layer.

3. A device according to claim 1, characterised in that the at least one wetting zone are functionalised chemically or biochemically.

4. A device according to claim 3, wherein said chemically or biochemically functionalised zones are hydrophilic zones of interaction with the moved liquid.

5. A device according to claim 1, further comprising an analysis means of the MALDI type by laser radiation desorption-ionisation, and/or of the optical detection type.

6. An integrated system for the microfluidic analysis of a liquid sample that includes at least one means for preparing the liquid sample, wherein said preparation means includes an electro-wetting moving means for the introduction of said sample and of reagents, and then their migration, to at least one means for the chemical or biochemical treatment of drops of said liquid sample, with said treatment means including an electro-wetting moving means for moving said drops of said sample and then their migration to at least one means for analysis of said drops of said liquid sample, with said analysis means being an analysis means by laser radiation desorption and including firstly an electro-wetting moving means for moving said drops of said sample, and secondly at least one means for routing the drops to independent analysis pads, wherein that at least one of said electro-wetting moving means includes at least one conducting pad covered by a partially wetting layer consisting in a layer made of a non-wetting material comprising wetting openings, said partially wetting layer having at least one wetting zone opposite to said conducting pad.

7. A system according to either of claim 6, wherein said preparation means includes at least one zone for the deposition of liquid.

8. A system according to claim 6, further comprising an insulating layer inserted between said conducting pad and said partially wetting layer.

9. A system according to claim 6, wherein said wetting zone is functionalised chemically or biochemically.

10. A system according to claim 9, wherein the chemically or biochemically functionalised zone is a hydrophilic zone of interaction with the moved liquid.

11. A system according to claim 6, wherein said means for moving in said chemical or biochemical treatment means includes two substrates opposite to each other.

12. A system according to claim 6, wherein the analysis means includes an analysis means of the MALDI type by laser radiation desorption-ionisation.

13. A system according to claim 6, wherein the analysis means includes an analysis means of the optical detection type.

14. A system according to claim 6 or claim 11, wherein said means for moving in said chemical or biochemical treatment means includes at least one means for fractionating one drop in several.

15. A system according to claim 6 or claim 11, wherein said means for moving in said chemical or biochemical treatment means includes at least one means for removing excess or exhausted reagents.

16. A system according to claim 6, wherein said means for moving in said chemical or biochemical treatment means at least one means for fractionating one drop in several and at least one means for removing excess or exhausted reagents.

17. A system according to claim 6, wherein said means for moving in said chemical or biochemical treatment means includes two substrates opposite to each other, and at least one means for fractionating one drop in several, and at least one means for removing excess or exhausted reagents.

* * * * *